US005592996A

United States Patent [19]

Keith et al.

[11] Patent Number: 5,592,996

[45] Date of Patent: Jan. 14, 1997

[54] DRILL BIT HAVING IMPROVED CUTTING STRUCTURE WITH VARYING DIAMOND DENSITY

[75] Inventors: Carl W. Keith, Spring; Graham Mensa-Wilmot, Houston, both of Tex.

[73] Assignee: Smith International, Inc., Houston, Tex.

[21] Appl. No.: 317,227

[22] Filed: Oct. 3, 1994

[51] Int. Cl.[6] ..... E21B 10/58

[52] U.S. Cl. ..... 175/431; 175/430

[58] Field of Search ..... 175/428, 430, 175/431

[56] References Cited

U.S. PATENT DOCUMENTS

| | | | |
|---|---|---|---|
| Re. 33,757 | 12/1991 | Weaver | 175/430 |
| Re. 34,435 | 11/1993 | Warren et al. | 175/398 |
| 4,429,755 | 2/1984 | Williamson | 175/431 |
| 4,444,281 | 4/1984 | Schumacher et al. | 175/431 X |
| 4,471,845 | 9/1984 | Jürgens | 175/431 |
| 4,475,606 | 10/1984 | Crow | 175/431 |
| 4,545,441 | 10/1985 | Williamson | 175/431 |
| 5,033,560 | 7/1991 | Sawyer et al. | 175/431 |
| 5,131,478 | 7/1992 | Brett et al. | 175/431 X |
| 5,178,222 | 1/1993 | Jones et al. | 175/431 X |
| 5,222,566 | 6/1993 | Taylor et al. | 175/431 |
| 5,238,075 | 8/1993 | Keith et al. | 175/431 |
| 5,265,685 | 11/1993 | Keith et al. | 175/431 |
| 5,346,025 | 9/1994 | Keith et al. | 175/431 X |
| 5,377,773 | 1/1995 | Tibbits | 175/397 |

FOREIGN PATENT DOCUMENTS

| | | | |
|---|---|---|---|
| 259872 | 3/1988 | European Pat. Off. | 175/431 |

*Primary Examiner*—David J. Bagnell

*Attorney, Agent, or Firm*—Gregory L. Maag; Conley, Rose & Tayon, P.C.

[57] ABSTRACT

A fixed cutter drill bit includes a cutting structure having radially-spaced sets of cutter elements. Each cutter in a set has a cutting profile that, in rotated profile, partially overlaps the cutting profiles of each of the other cutters that are in the same set so as to create a region of maximum diamond density. The region of maximum diamond density in a set is defined such that the centerlines of the cutting profiles of the elements in the set pass through the region of maximum diamond density. The cutting profiles of the spaced sets of cutters also may overlap to create border regions of multiple diamond density. The diamond density of border regions is less than or equal to the density in the region of maximum diamond density. Providing such regions of varying diamond density along the bit face tends to increase the bit's ability to resist vibration and provides an aggressive cutting structure, even after significant wear has occurred.

48 Claims, 8 Drawing Sheets

DRILL BIT HAVING IMPROVED CUTTING STRUCTURE WITH VARYING DIAMOND DENSITY

FIELD OF THE INVENTION

This invention relates generally to fixed cutter drill bits of the type typically used in cutting rock formation such as used in drilling an oil well or the like. More particularly, the invention relates to bits utilizing polycrystalline diamond cutting elements that are mounted on the face of the drill bit, such bits typically referred to as "PDC" bits.

BACKGROUND OF THE INVENTION

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downwardly, causing the bit to cut through the formation material by either abrasion, fracturing, or shearing action, or through a combination of all cutting methods. While the bit is rotated, drilling fluid is pumped through the drill string and directed out of the drill bit through nozzles that are positioned in the bit face. The drilling fluid is provided to cool the bit and to flush cuttings away from the cutting structure of the bit. The drilling fluid and cuttings are forced from the bottom of the borehole to the surface through the annulus that is formed between the drill string and the borehole.

Many different types of drill bits and bit cutting structures have been developed and found useful in drilling such boreholes. Such bits include fixed cutter bits and roller cone bits. The types of cutting structures include milled tooth bits, tungsten carbide insert ("TCI") bits, PDC bits, and natural diamond bits. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability. In formations of soft and medium hardness, fixed cutter bits having a PDC cutting structure have been employed with varying degrees of success.

The cost of drilling a borehole is proportional to the length of time it takes to drill the borehole to the desired depth and location. The drilling time, in turn, is greatly affected by the number of times the drill bit must be changed, in order to reach the targeted formation. This is the case because each time the bit is changed, the entire drill string—which may be miles long—must be retrieved from the borehole section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, it is always desirable to employ drill bits which will drill faster and longer and which are usable over a wider range of differing formation hardnesses.

The length of time that a drill bit may be employed before the drill string must be tripped and the bit changed depends upon the bit's rate of penetration ("ROP"), as well as its durability or ability to maintain a high or acceptable ROP. Additionally, a desirable characteristic of the bit is that it be "stable" and resist vibration. The most severe type or mode of vibration is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes the premature wearing or destruction of the cutting elements and a loss of penetration rate.

In recent years, the PDC bit has become an industry standard for cutting formations of soft and medium hardnesses. The cutter elements used in such bits are formed of extremely hard materials and include a layer of thermally stable polycrystalline diamond material. In the typical PDC bit, each cutter dement or assembly comprises an elongate and generally cylindrical support member which is received and secured in a pocket formed in the surface of the bit body. A disk or tablet-shaped, preformed cutting element having a thin, hard cutting layer of polycrystalline diamond is bonded to the exposed end of the support member, which is typically formed of tungsten carbide. Although such cutter elements historically were round in cross section and included a disk shaped PDC layer forming the cutting face of the dement, improvements in manufacturing techniques have made it possible to provide cutter elements having PDC layers formed in other shapes as well.

A common arrangement of the PDC cutting elements was at one time to place them in a spiral configuration. More specifically, the cutter elements were placed at selected radial positions with respect to the central axis of the bit, with each element being placed at a slightly more remote radial position than the preceding element. So positioned, the path of all but the center-most elements partly overlapped the path of movement of a preceding cutter element as the bit was rotated. Thus, each element would remove a lesser volume of material than would be the case if it were radially positioned so that no overlapping occurred, or occurred to a lesser extent, because the leading cutter element would already have removed some formation material from the path being traveled by the following cutter element. Using this arrangement of cutters, each cutter tended to remove a comparatively small amount of material from the formation during each revolution, and was subjected to substantially the same loading as the other cutter elements on the bit face.

Although the spiral arrangement was once widely employed, this arrangement of cutter elements was found to wear in a manner to cause the bit to assume a cutting profile that presented a relatively flat and single continuous cutting edge from one element to the next. Not only did this decrease the ROP that the bit could provide, it but also increased the likelihood of bit vibration. Both of these conditions are undesirable. A low ROP increases drilling time and cost, and may necessitate a costly trip of the drill string in order to replace the dull bit with a new bit. Excessive bit vibration will itself dull the bit or may damage the bit to an extent that a premature trip of the drill string becomes necessary.

Thus, in addition to providing a bit capable of drilling effectively at desirable ROP's through a variety of formation hardnesses, preventing bit vibration and maintaining stability of PDC bits has long been a desirable goal, but one which has not always been achieved. Bit vibration may occur in any type of formation, but is most detrimental in the harder formations. As described above, the cutter elements in many prior art PDC bits were positioned in a spiral relationship which, as drilling progressed, wore in a manner which caused the ROP to decrease and which also increased the likelihood of bit vibration.

There have been a number of designs proposed for PDC cutting structures that were meant to provide a PDC bit capable of drilling through a variety of formation hardnesses at effective ROP's and with acceptable bit life or durability. For example, U.S. Pat. No. 5,033,560 (Sawyer et al.) describes a PDC bit having mixed sizes of PDC cutter elements which are arranged in an attempt to provide improved ROP while maintaining bit durability. The '560 patent is silent as to the ability of the bit to resist vibration and remain stable. Similarly, U.S. Pat. No. 5,222,566 (Taylor et at.) describes a drill bit which employs PDC cutter elements of differing sizes, with the larger size elements employed in a first group of cutters, and the smaller size employed in a second group. This design, however, suffers from the fact that the cutter elements do not share the cutting load equally. Instead, the blade on which the larger sized cutters are grouped is loaded to a greater degree than the blade with the smaller cutter elements. This could lead to blade failure. U.S. Pat. No. Re 33,757 (Weaver) describes still another cutting structure having a first row of relatively sharp, closely-spaced cutter elements, and a following row of widely-spaced, blunt or rounded cutter elements for dislodging the formation material between the kerfs or grooves that are formed by the sharp cutters. While this design was intended to enhance drilling performance, the bit includes no features directed toward stabilizing the bit once wear has commenced. Further, the bit's cutting structure has been found to limit the bit's application to relatively brittle formations.

Separately, other attempts have been made at solving bit vibration and increasing stability. For example, U.S. Pat. No. Re 34,435 (Warren et al.) describes a bit intended to resist vibration that includes a set of cutters which are disposed at an equal radius from the center of the bit and which extend further from the bit face than the other cutters on the bit. According to that patent, the set of cutters extending furthest from the bit face are provided so as to cut a circular groove within the formation. By design, the extending cutters ride in the groove which tends to stabilize the bit. Similarly, U.S. Pat. No. 5,265,685 (Keith et at.) discloses a PDC bit that is designed to cut a series of grooves in the formation such that the resulting ridges formed between each of the concentric grooves tend to stabilize the bit. U.S. Pat. Nos. Re 34,435 and 5,265,685 both disclose using the same sized cutter elements. U.S. Pat. No. 5,238,075 (Keith et at.) also describes a PDC bit having a cutter element arrangement which employs cutter elements of different sizes and which, in part, was hoped to provide greater stabilization. However, many of these designs aimed at minimizing vibration required that drilling be conducted with an increased weight-on-bit ("WOB") as compared with bits of earlier designs. Drilling with an increased or heavy WOB has serious consequences and is avoided whenever possible. Increasing the WOB is accomplished by adding additional heavy drill collars to the drill string. This additional weight increases the stress and strain on all drill string components, causes stabilizers to wear more quickly and to work less efficiently, and increases the hydraulic pressure drop in the drill string, requiring the use of higher capacity (and typically higher cost) pumps for circulating the drilling fluid.

Thus, despite attempts and certain advances made in the art, there remains a need for a fixed cutter bit having an improved cutter arrangement which will permit the bit to drill effectively at economical ROP's and, ideally, to drill in formations having a hardness greater than that in which conventional PDC bits can be employed. More specifically, there is a need for a PDC bit which can drill in soft, medium, medium hard and even in some hard formations while maintaining an aggressive cutter profile so as to maintain acceptable ROP's for acceptable lengths of time and thereby lower the drilling costs presently experienced in the industry. Such a bit should also provide an increased measure of stability as wear occurs on the cutting structure of the bit so as to resist bit vibration. Ideally, the increased stability of the bit should be achieved without having to employ substantial additional WOB and suffering from the costly consequences which arise from drilling with such extra weight.

SUMMARY OF THE INVENTION

Accordingly, there is provided herein a drill bit particularly suited for drilling through a variety of formation hardnesses with normal WOB at improved penetration rates while maintaining stability and resisting bit vibration. The bit may be successfully employed in formations of greater hardness than can typically be drilled using conventional PDC bits.

The bit generally includes a cutting structure having groups or sets of cutter elements that are mounted in spaced apart relationship on the bit face. The cutter elements in each set are likewise spaced apart along the bit face. Each set includes a cutting profile that is defined by the cutting profiles of the cutter elements in the set when viewed in rotated profile, and includes a number of regions of differing diamond density along the segment of the bit face that is spanned by the set cutting profile. Each set cutting profile includes a region of maximum diamond density that is defined by the area of intersection of the cutting profiles of each of the cutter elements in the set, the cutting profile of each element partially, but not totally, overlapping the cutting profile of each of the other cutter elements in the same set. The cutter elements in a set are spaced such that the centerline of the cutting profile of each cutter element intersects the region of maximum diamond density.

The sets may be spaced so that the set cutting profiles of adjacent sets overlap when viewed in rotated profile. The area of overlap of the set cutting profiles forms a border region which has a diamond density equal to or less than the diamond density of the region of maximum diamond density of the sets.

Depending upon the hardness and composition of the formation that is to be drilled, as well as other factors, the cutter elements in a set, and the sets themselves, may be spaced apart at various distances so as to position the regions of maximum diamond density and border regions at predetermined radial locations on the bit face that may be most desirable in a given application. Also, depending upon various design factors, the cutter elements employed may have cutting profiles of various sizes and shapes. For example, in certain situations, it may be desirable to have a first set of cutter elements having round cutting profiles and the second set having scribe cutters with pointed cutting profile. Likewise, the sizes and shapes of the cutter elements within any set may be varied. For example, it may be desirable to employ two or more scribe shaped cutters in a set and position a round cutter element in the same set. Further, depending upon the application, the cutter elements in a set may be mounted so as to have varying exposures heights relative to the formation material being cut by the bit.

As the bit rotates in the borehole, a portion of the cutting profile of each cutter element in the set is partially hidden from the formation material by a portion of each of the other cutter elements in the same set. As the bit wears, the regions of maximum diamond density remain well-defined in rotated profile and suffer from less wear than the adjacent regions having lesser diamond densities. Thus, the bit face presents varying diamond densities and different wear gradients along the bit cutting structure profile. As drilling progresses, this design creates a pattern of alternating grooves and ridges in the formation material tending to stabilize the bit, without requiring the increased WOB as was often necessary to drill with prior art bits where increased stability was desired.

The invention may also include cutter elements having elongate cutting profiles with terminal ends most exposed to the formation material and root ends opposite the terminal ends. In such an embodiment, the elongate elements are positioned such that, in rotated profile, their terminal ends overlap to form the region of maximum diamond density. The root ends of the cutting profiles of cutters in adjacent sets may also overlap to form a border region of multiple diamond density between the regions of maximum diamond density. This arrangement results in a series of highly defined peaks and recesses to successfully counter any lateral instability of the bit. Such elongate cutters may have a variety of shapes such as, link shape, rectangular shape, teardrop shape or others.

Thus, the present invention comprises a combination of features and advantages which enable it to substantially advance the drill bit art by providing apparatus for effectively and efficiently drilling through a variety of formation hardnesses at economic rates of penetration and with superior bit durability. The bit drills more economically than many prior art PDC bits and drills with less vibration and greater stability, even after substantial wear has occurred to the cutting structure of the bit. Further, drilling with the bit does not also require additional or excessive WOB. These and various other characteristics and advantages of the present invention will be readily apparent to those skilled in the art upon reading the following detailed description of the preferred embodiments of the invention, and by referring to the accompanying drawings.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

Figure 1:
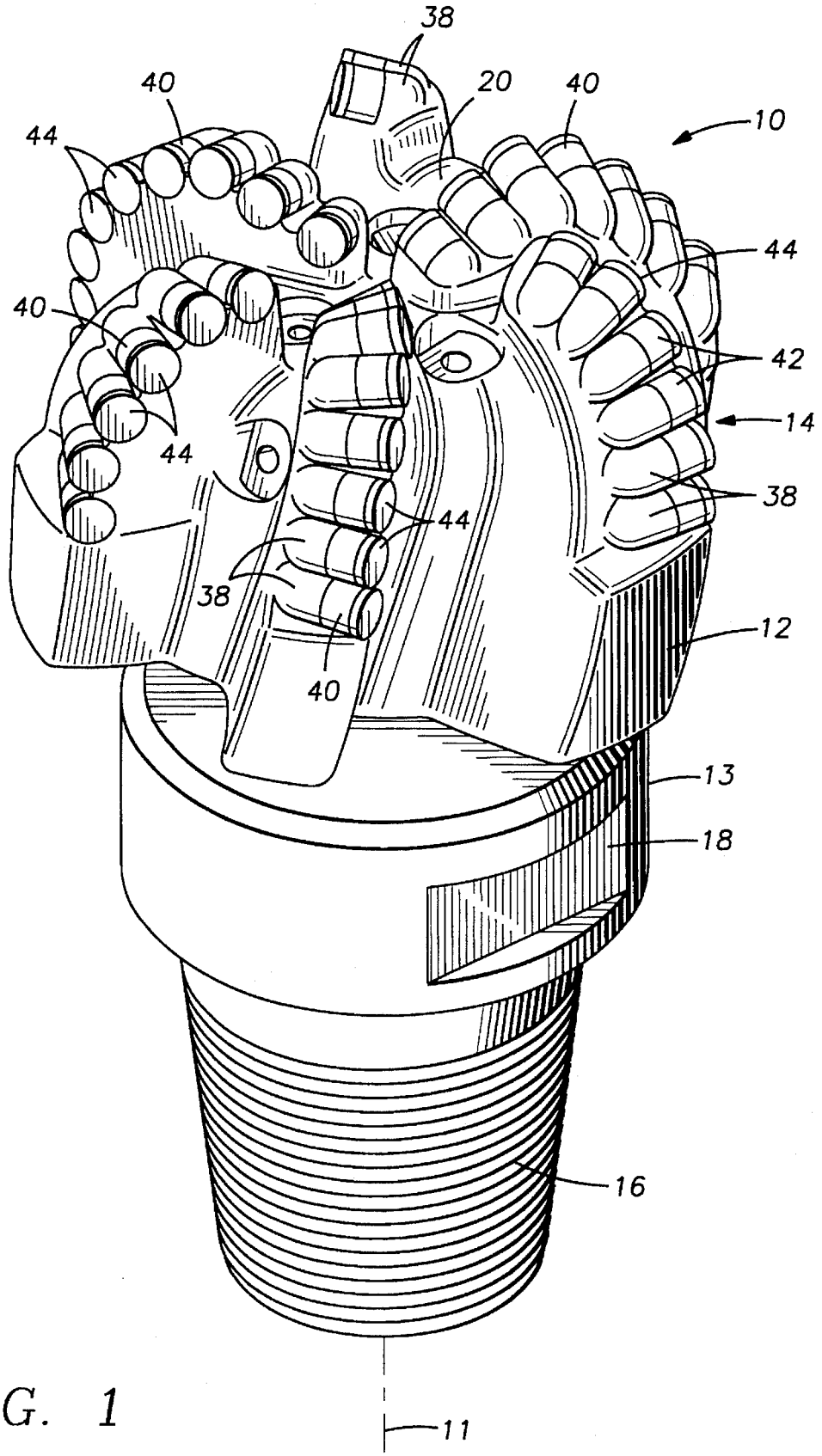
FIG. 1 is a perspective view of a drill bit made in accordance with the present invention.
Figure 2:
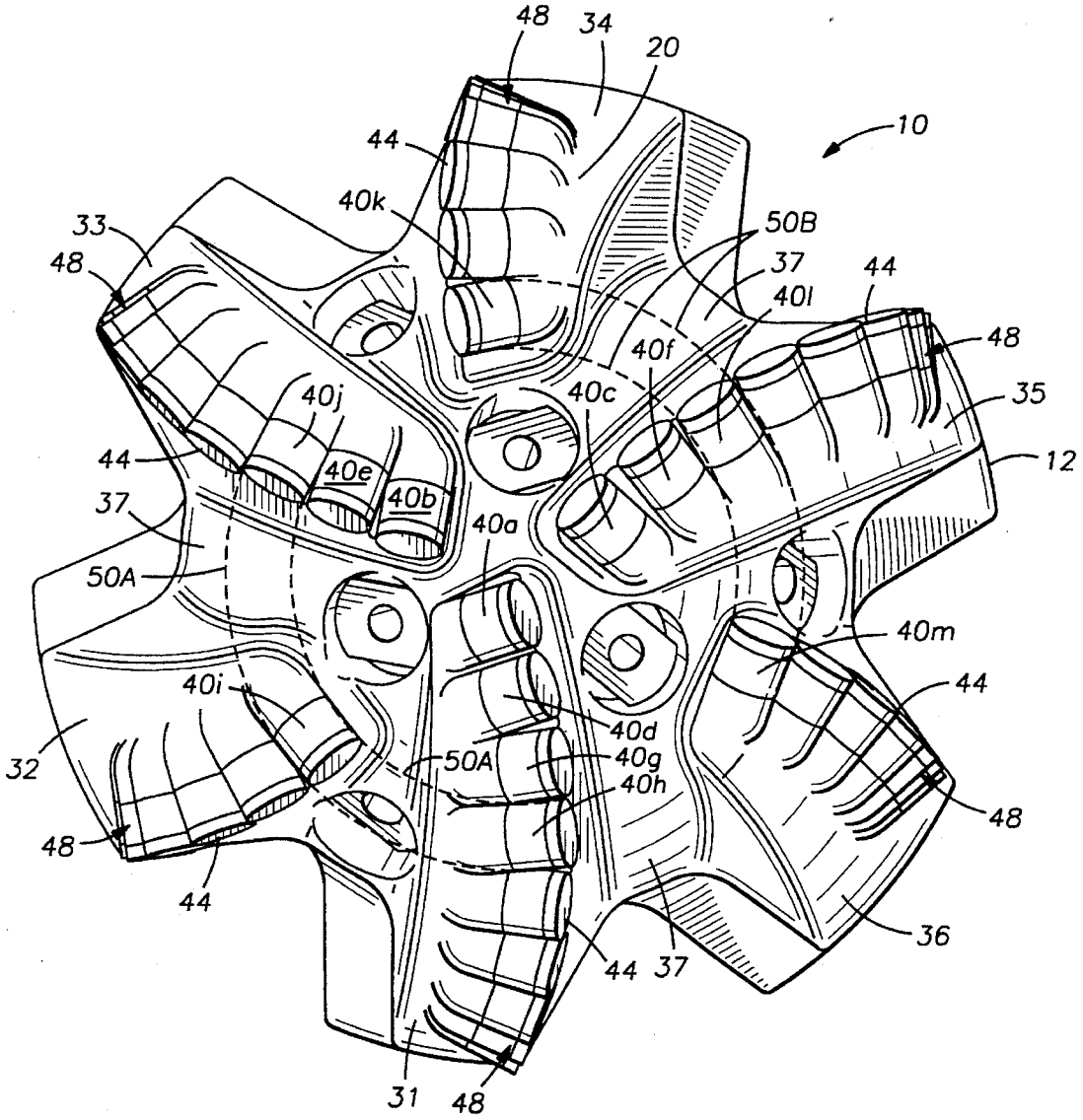
FIG. 2 is a plan view of the cutting end of the drill bit shown in FIG. 1.
Figure 3:
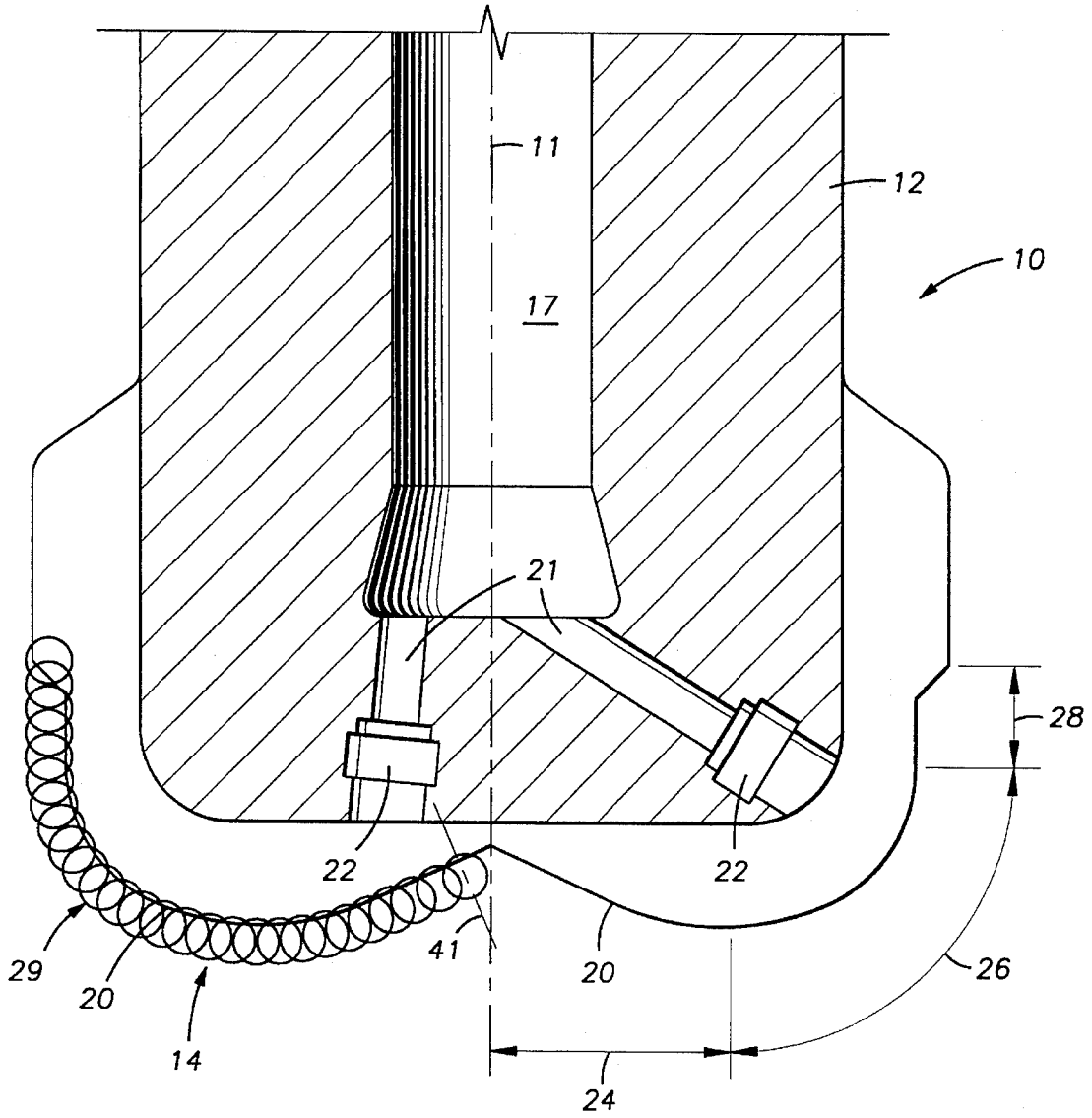
FIG. 3 is an elevational view, partly in cross-section, of the drill bit shown in FIG. 1 with the cutter elements shown in rotated profile collectively on one side of the central axis of the drill bit.

A drill bit 10 embodying the features of the present invention is shown in FIGS. 1–3. Bit 10 is a fixed cutter bit, sometimes referred to as a drag bit, and is adapted for drilling through formations of rock to form a borehole. Bit 10 generally includes a bit body 12, shank 13, and threaded connection or pin 16 for connecting bit 10 to a drill string (not shown) which is employed to rotate the bit for drilling the borehole. Bit 10 further includes a central axis 11 and a PDC cutting structure 14.

Body 12 includes a central longitudinal bore 17 (FIG. 3) for permitting drilling fluid to flow from the drill string into the bit. A pair of oppositely positioned wrench flats 18 (one shown in FIG. 1) are formed on the shank 13 and are adapted for fitting a wrench to the bit to apply torque when connecting and disconnecting bit 10 from the drill string.

Bit body 12 includes a bit face 20 which is formed on the end of the bit 10 that is opposite pin 16 and which supports cutting structure 14, described in more detail below. Body 12 is formed in a conventional manner using powdered metal tungsten carbide particles in a binder material to form a hard metal cast matrix. Steel bodied bits, those machined from a steel block rather than a formed matrix, may also be employed in the invention. In the preferred embodiment shown, bit face 20 includes six angularly spaced-apart blades 31–36 which are integrally formed as part of and which extend from body 12. Blades 31–36 extend radially across the bit face 20 and longitudinally along a portion of the periphery of the bit. Blades 31–36 are separated by grooves which define drilling fluid flow courses 37 between and along the cutting faces 44 of the cutter elements 40, which are mounted on bit face 20 and described in more detail below. Again in the preferred embodiment shown in FIG. 2, blades 31, 33 and 35 are equally spaced 120° apart, while blades 32, 34 and 36 lag behind blades 31, 33 and 35 by 55°. Given this angular spacing, blades 31–36 may be considered to be divided into pairs of "leading" and "lagging" blades, a first such blade pair comprising blades 31 and 32, a second pair comprising blades 33 and 34, and a third pair including blades 35 and 36.

As best shown in FIG. 3, body 12 is also provided with downwardly extending flow passages 21 having nozzles 22 disposed at their lowermost ends. In the preferred embodiment, bit 10 includes six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Referring now to FIG. 3, to aid in an understanding of the more detailed description which follows, bit face 20 may be said to be divided into three different zones or regions 24, 26, 28. The central portion of the bit face 20 is identified by the reference numeral 24 and may be concave as shown. Adjacent central portion 24 is the shoulder or the upturned curved portion 26. Next to shoulder portion 26 is the gage portion 28, which is the portion of the bit face 20 which defines the diameter or gage of the borehole drilled by bit 10. As will be understood by those skilled in the art, regions 24, 26, 28 are approximate and are identified only for the purposes of better describing the distribution of cutter elements 40 over the bit face 20, as well as certain other inventive features of the present invention.

As best shown in FIG. 1, each cutter element 40 is mounted within a pocket 38 which is formed in the bit face 20 on one of the radially and longitudinally extending blades 31–36. Cutter elements 40 are constructed by conventional methods and each typically includes a base or support member 42 having one end secured within a pocket 38 by brazing or similar means. The support 42 is comprised of a sintered tungsten carbide material having a hardness greater than that of the body matrix material. Attached to the opposite end of the support member 42 is a layer of extremely hard material, preferably a synthetic polycrystalline diamond material which forms the cutting face 44 of element 40. Such cutter elements 40, generally known as polycrystalline diamond composite compacts, or PDC's, are commercially available from a number of suppliers including, for example, Smith Sii Megadiamond, Inc. or General Electric Company, which markets compacts under the trademark STRATAPAX.

As shown in FIGS. 1 and 2, the cutter elements 40 are arranged in separate rows 48 along the blades 31–36 and are positioned along the bit face 20 in the regions previously described as the central portion 24, shoulder 26 and gage portion 28. Cutter elements 40 are mounted on the blades 31–36 in selected radial positions relative to the central axis 11 of the bit 10. The cutting faces 44 of the cutter elements 40 are oriented in the direction of rotation of the drill bit 10 so that the cuffing face 44 of each cutter element 40 engages the earth formation as the bit 10 is rotated and forced downwardly through the formation.

Figure 4:
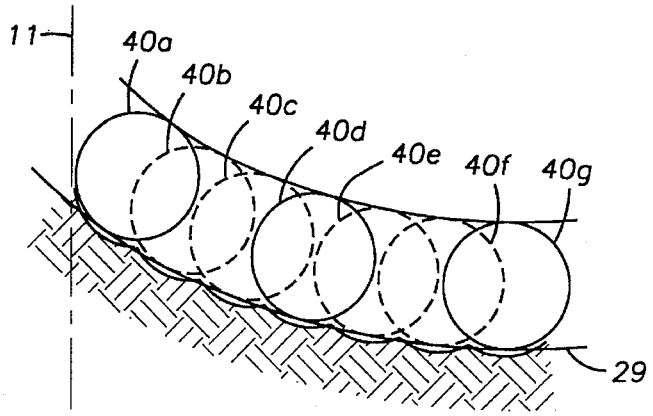
FIG. 4 is an enlarged view of a portion of FIG. 3 showing the overlapping of the cutting profiles of the cutter elements that are located adjacent to the bit axis.

Referring again to FIGS. 2 and 3, each row 48 includes a number of cutter elements 40 radially spaced from each other relative to the bit axis 11. As is well known in the art, cutter elements 40 are radially spaced such that the groove or kerf formed by the cutting profile of a cutter element 40 overlaps to a degree with kerfs formed by one or more cutter elements 40 of other rows 48. Such overlap is best understood in a general sense by referring to FIG. 4 which schematically shows, in rotated profile, the relative radial positions of the most centrally located cutter elements 40, that is, those elements 40 positioned closest to bit axis 11 which have been identified in FIGS. 2 and 4 with the reference characters 40*a*–40*g*. As shown, elements 40*a*, 40*d* and 40*g* are radially spaced in a first row 48 on blade 31. As bit 10 is rotated, these elements will cut separate kerfs in the formation material, leaving ridges therebetween. As the bit 10 continues to rotate, cutter elements 40*b* and 40*c*, mounted on blades 33 and 35, respectively, will cut the ridge that is left between the kerfs made by cutter elements 40*a* and 40*d*. Likewise, elements 40*e* and 40*f* (also mounted on blades 33 and 35, respectively) cut the ridge between the kerfs formed by elements 40*d* and 40*g*. With this radial overlap of cutter 40 profiles, the bit cuffing profile may be generally represented by the relatively smooth curve 29 formed by the outer-most edges of cutting faces 44 of cutters 40 as shown in FIG. 3, which depicts the cutter elements 40 of the bit 10 in rotated profile collectively on one side of central bit axis 11.

As will be understood by those skilled in the art, certain cutter elements 40 are positioned on the bit face 20 at generally the same radial position as other elements 40 and therefore follow in the same swath or kerf cut by a preceding cutter element 40. As used herein, such elements may be referred to as "redundant" cutters. In the rotated profile of FIG. 3, the distinction between such redundant cutter elements cannot be seen. Further, as explained below, the present invention provides that some of the cutter elements 40 be disposed relatively close in the radial sense to other cutter elements 40 such that, in rotated profile, the cutting faces 44 of these elements present partially overlapping cutting profiles. These sometimes small differences in radial position are not visible in FIG. 3, but are described in more detail below.

In addition to being mounted in rows 48, cutter elements 40 in the present invention are also arranged in groups or sets 50, each cutter set 50 including cutter elements 40 from various rows 48. Cutter sets 50 may include two, three or any greater number of cutter elements 40. In one preferred embodiment of the invention, each cutter set 50 includes three elements 40, each of which is positioned on a different blade 31–36. For illustrative purposes, two of such sets 50A, 50B are generally shown enclosed by dashed lines in FIG. 2.

Figure 5:
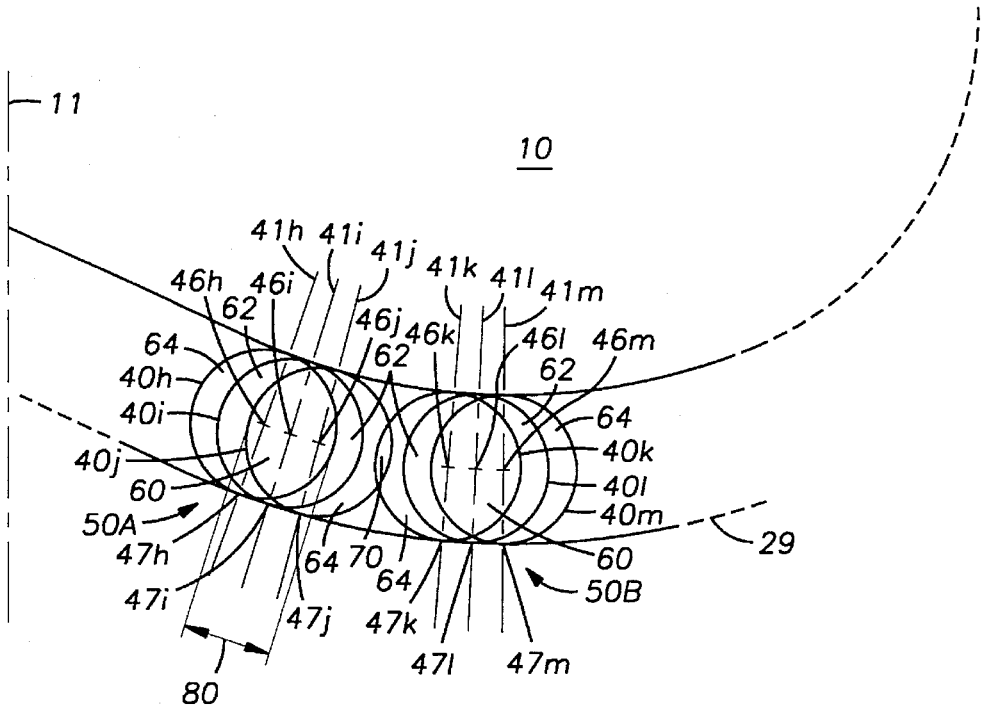
FIG. 5 is an enlarged view similar to FIG. 4 showing schematically, in rotated profile, the relative radial positions of certain of the cutter elements and cutter element sets that are mounted on the drill bit shown in FIG. 1.

Referring now to FIG. 5, cutter element sets 50A, 50B are shown in rotated profile in relation to bit axis 11. Cutter element set 50A includes cutter elements 40*h*, 40*i*, 40*j* and set 50B includes elements 40*k*, 40*l* and 40*m*. In this embodiment, the cutting faces 44 of elements 40*h–m* are mounted with zero degrees of backrake, thus the cutting profiles of elements 40*h–m* are circular. The cutting profiles of elements 40*h–m* include centerlines 41*h–m*. As used herein, the centerline 41 of a cutting profile refers to the line that is defined by the centroid 46 of the element cutting profile, and the point 47 on the element cutting profile that lies on the bit cutting profile 29. Points 47, sometimes generally referred to as the cutting tips of cutter elements 40, are those points on the cutting face 44 that are most exposed to the formation material and that, collectively, define the bit cutting profile 29. As shown in FIG. 5, centerline 41*h* of the cutting profile of element 40*h* passes through centroid 46*h* and point 47*h*. Similarly, centerlines 41*i–m* pass through their respective centroids 46*i–m* and the points 47*i–m* on bit cutting profile 29. In the case of a symmetrically shaped cutting profile, such as the profiles of elements 40*h–m* of FIG. 5, the centerline 41 will bisect the profile.

Referring to FIGS. 2 and 5, the cutter elements 40 of each set 50 are mounted in different blades of the bit. More specifically, elements 40*h*, 40*i* and 40*j* are mounted on blades 31, 32 and 33, respectively. Elements 40*k*, 40*l* and 40*m* are mounted on blades 34, 35 and 36, respectively. Although this embodiment of the invention is depicted in FIGS. 1 and 2 on a six-bladed bit 10, the principles of the present invention can of course be employed in bits having any number of blades, and the invention is not limited to a bit having any particular number of blades or angular spacing of the blades. Further, although the arrangement of FIG. 5 shows each cutter elements 40 in a set to be positioned on a different blade, depending on the number of cutter elements 40 in the set, the size of the elements, and the desired spacial relationship of the elements, more than one element in a set may be positioned on the same blade.

As best shown in FIG. 5, the cutter elements 40 in each set 50 are mounted so as to have differing radial positions relative to bit axis 11; however, the difference in radial position between elements 40 in a set 50 is relatively slight such that, in rotated profile, each cutter element 40 in a set 50 has a cutting profile that partially overlaps the cutting profile of each of the other cutter elements 40 in the same set 50. The area of the cutting profile of an element may be the same as or different from the area of the element's cutting face 44, depending on the degree of rake at which the cutter element is mounted in the bit face. The common area of intersection of the overlapping element cutting profiles form a region of maximum diamond density 60 as the bit is rotated in the borehole. To provide the most desired or optimum diamond density for a set 50 of cutters, it has been found that the cutter elements 40 within set 50 should be relatively closely spaced in the radial sense with respect to bit axis 11 such that the centerline 41 of the cutting profile of each element 40 in the set 50 intersects or passes through the region 60 of maximum diamond density. As shown in FIG. 5, the region 60 of maximum diamond density in set 50A is defined by the common area of intersection (in rotated profile) of the cutting profiles of elements 40*h*, 40*i*, 40*j*. Likewise, region 60 in set 50B is defined by the common area of intersection of the cutting profiles of elements 40*k*, 40*l*, 40*m*.

In addition to area 60 having maximum diamond density, each set 50A, 50B includes two regions 62 which are formed by the overlapping cuffing profiles of two elements 40 and which thus have a diamond density less than the diamond density of region 60, but a greater diamond density than that provided by a single cutter element 40. In the embodiment shown in FIG. 5, regions 62 may be said to have a double diamond density. The regions designated by reference numeral 64 have a single diamond density, as the cutting profile of those portions of the cutter elements 40 which define regions 64 do not overlap with the cuffing profile of any cutters within the same set 50. As is apparent, each cutter set 50A, 50B includes its own cutting profile which comprises the sum of the regions 60, 62 and 64 and which thus includes various regions of differing diamond density formed along that segment of bit face 20 that is spanned by the set cutting profile.

The present invention also contemplates having a plurality of cutter element sets 50 with cutting profiles that, in rotated profile, overlap to varying degrees the cutting profiles of adjacent cutter element sets 50. Cutter element sets 50A, 50B thus include cutting profiles which overlap to form a border region 70 of multiple diamond density. In the embodiment shown in FIG. 5, border region 70 has the same diamond density as regions 62. In each set, the diamond density of a border region 70 will be less than or equal to the diamond density of the region of maximum diamond density 60 of each set 50, but will not have a greater diamond density than region 60. Also as shown, due to the shape and size of the cutting profile of cutters 40*h*–40*m* shown in this exemplary embodiment, border region 70 will have the same shape as regions 60, but will have a width less than the width of regions 60.

Referring still to FIGS. 1, 2 and 5, as the bit 10 is rotated about its axis 11, the blades 31–36 sweep around the bottom of the borehole causing the cutter elements 40 to each cut a trough or kerf within the formation material. Assuming a rotation of bit 10 in the counterclockwise direction as viewed in FIG. 2, cutter elements 40*i* and 40*j* partially follow in the kerf initially cut by cutter element 40*h*. Thus, because elements 40*i* and 40*j* are not called upon to cut as great a volume of formation material as elements 40*h*, portions of the cutting faces 44 of elements 40*i* and 40*j* may be considered partially "hidden" from the formation by element 40*h*. The hidden portions of cutter elements 40*i* and 40*j* will not wear as quickly as those portions that are entirely exposed to the formation. In the identical manner, because of the overlapping cutting profiles of the cutter elements in set 50A, portions of elements 40*h* and 40*j*, are hidden from the formation material by element 40*i*, and portions of elements 40*i* and 40*h* are hidden by element 40*j*. Thus, as bit 10 is rotated, cutting faces 44 of elements 40*h*–40*m* engage the formation material and cut kerfs in the formation as the bit is rotated. Because of their overlapping cutting profiles, the swaths cut by elements 40*h*–40*m* also overlap to the extent represented by the overlapping cutter element profiles shown in FIG. 5. As the bit continues to drill, the cutter elements 40 will begin to wear as the result of abrasion from the formation material; however, because of the overlap of cutting profiles of the elements 40 in sets 50A, 50B and the resulting varying diamond densities across bit face 20, certain portions of the cutter elements 40*h*–40*m* will wear faster than other portions. More specifically, those portions of elements 40*h*–40*m* which, in rotated profile, form regions 60 having maximum diamond density will wear less than those portions forming regions 62 and 64 where the diamond density is less. As is apparent, region 64 having only a single diamond density will wear the fastest, whereas regions 62 and 70, which in the embodiment shown in FIG. 5 include regions of double diamond density, will wear quicker than region 60, but not as fast as region 64.

Providing this variable diamond density across the span of a set cutting profile and across the bit face 20 helps the bit maintain an aggressive cutting structure and prolongs the life of the bit. Simultaneously, the variable diamond density provides a stabilizing effect on the bit and lessens the likelihood of damaging bit vibration occurring as the bit wears. Stabilization is achieved because as the bit wears, the regions of maximum diamond density 60 remain relatively unworn. These maximum diamond density regions 60 are spaced apart along the bit face such that, in rotated profile, the bit 10 cuts a series of concentric grooves that are separated by well defined ridges that are formed between the regions of maximum density 60 of adjacent cutter sets 50. These ridges will tend to make the bit highly resistant to lateral movement due to increased side loading provided by the ridges on the cutter elements 40 of sets 50. The bit 10 will thus tend to remain stable and resist bit vibration.

Although sets 50A, B are depicted in FIG. 5 as consisting of three elements 40 per set 50, the invention is in no way limited to any specific number of cutter elements 40 in a set 50. That is, a set 50 may include two, three, or more elements 40 in the same set 50. Also, although each set 50 is shown in FIG. 5 to include an equal number of cutter elements 40, the number of cutter elements in the sets 50 may vary on the same bit. For example, at a radial position on the bit face that is subjected to particularly severe loading, it may be desirable to position a greater number of cutter elements 40 in a set 50 than at a radial position that is not as highly loaded. Similarly, the degree or extent of overlap of cutting profiles of elements 40 in sets 50 may be varied from set to set across the bit face 20. For example, the number of cutter elements 40 in a set may increase, and the spacing between adjacent sets 50 decrease, upon moving from bit axis 11 toward gage portion 28.

Also, it is preferred that the cutting structure 14 and bit 10 of the present invention include additional cutters 40 and sets 50 in redundant positions to those of cutter elements 40*h–m* and sets 50A, 50B shown in FIG. 5. For example, a set 50 of three cutter elements 40 that are redundant to the positions of elements 40*k–m* of cutter set 50B may be mounted on the bit face 20 such that, in rotated profile, the cutting profile of these additional cutters 40 would coincide with those of elements 40*k–m*. Such an arrangement would provide for increased diamond density throughout the region that is spanned by the cutting profile of set 50B, and would provide, in this example, two aligned regions of maximum diamond density 60 which effectively would increase the diamond density at the regions of the bit face 20 to twice that provided by single region 60. Alternatively, a set 50 may have three cutters 40 that are positioned as elements 40*k–m* but at the same respective radial positions as elements 40*k–m* but at exposure heights such that they are more exposed (or less exposed) to the formation material than elements 40*k–m*. Within the limits imposed by the physical size and other design parameters of the bit 10, any number of redundant cutters 40 and sets 50 (or cutters 40 and sets 50 having the same radial positions but varying exposure heights) may be positioned on the bit to yield desirable diamond densities at predetermined radial positions along the bit face; however, in accordance with the present invention, the cutting profile of each set 50 lies at least partially outside the cutting profile of each cutter element 40 on the bit 10. In other words, cutter elements 40 are mounted on bit 10 such that, in rotated profile, a set's cutting profile does not fall entirely within the cutting profile of a single cutter element. It is believed that such an arrangement of cutters and cutter sets will provide for increased stability of the bit and enhanced ROP's initially and after wear has occurred, and will do so without the necessity of drilling with the increased WOB typically required for prior art bits that were intended to provide some measure of improvement in bit stability.

Certain preferred variations or alternative embodiments to the drill bit and cutter arrangement previously described are shown in FIGS. 6–16. In describing these embodiments, similar reference numerals and characters will be used to identify like or common elements.

Figure 6:
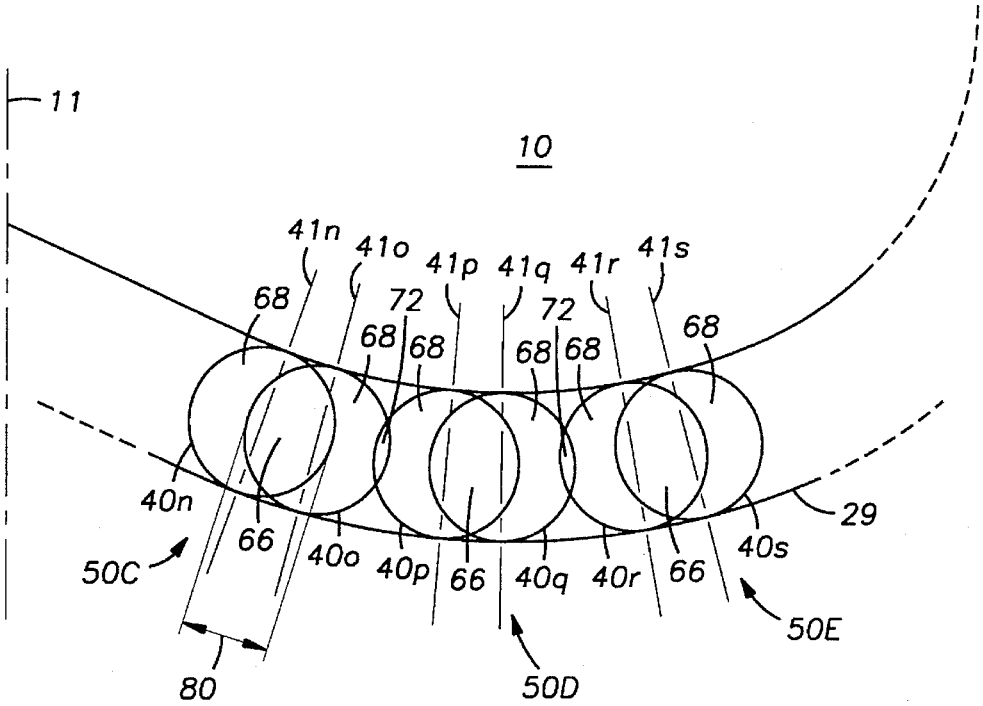
FIGS. 6–9 are views similar to FIG. 5 showing alternative embodiments of the present invention.

Referring now to FIG. 6, a bit 10 is shown having three cutter dement sets 50C, 50D, 50E, each of which includes two cutter elements 40. Sets 50C–E collectively include elements 40*n–s*. Elements 40*n–s* are identical in structure as those elements 40 previously described with reference to FIGS. 1–5. As shown in FIG. 6, each set 50C–E includes two cutter elements 40 having cutting profiles which overlap to form region 66 of maximum diamond density. The centerline 41 of each element cutting profile intersects the region of maximum diamond density 66 in its respective cutter set 50. In this arrangement, region 66 having maximum diamond density has a diamond density that is double that of region 68 which has only a single diamond density. The cutting profiles of cutter element sets 50C–E overlap one another to form border regions 72 which, in this arrangement, have diamond densities identical to the diamond densities of regions 66.

Although as described below, the invention is not limited to bits with cutter elements having cutting profiles of the same size and shape, when cutter elements 40 are employed in a cutter element set 50 and do have profiles of the same size and shape, the width of the region of maximum diamond density 66 is greater than one-half the width of the cutting profile of the cutter element 40 employed in the set. As used herein, the width of the cutting profile of an element 40 is measured perpendicular to the centerline 41 of the profile at the profile's widest point. Specifically, referring to FIG. 5, the width of region 60, represented by arrow 80, is greater than one-half the diameter of the cutting profile of each of the elements 40*h–j*. Likewise, with reference to FIG. 6, the width shown by arrow 80 of maximum diamond density region 66 is likewise greater than one-half the diameter or width of the cutting profile of cutter elements 40*n*, 40*o*. A bit having the arrangement of cutter elements 40 and cutter sets 50 as shown in FIG. 6 will maintain an aggressive and effective cutting structure and will provide enhanced bit stability even as the cutter elements wear during use.

Figure 7:
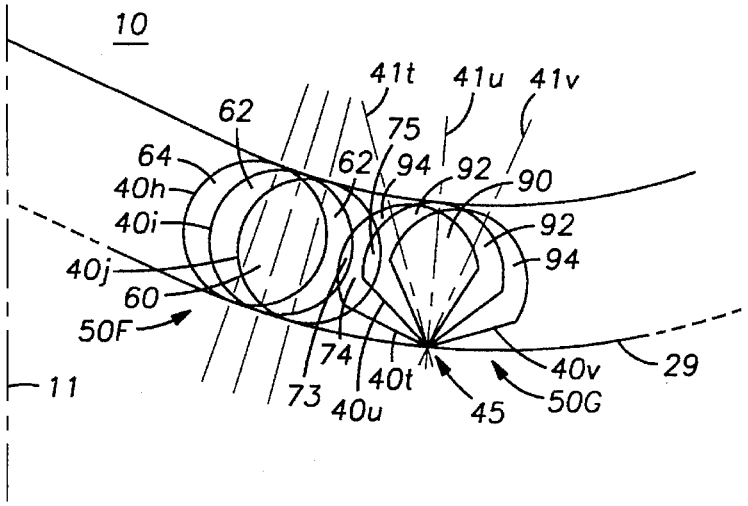

Referring now to FIG. 7, as described briefly above, the scope or application of the present invention is not limited to any particular size, shape or number of cutter elements 40 or sets of elements 50. For example, shown in FIG. 7 are two sets 50F, 50G of cutter elements 40. Set 50F will be understood to be comprised of cutter elements 40*h–j* and to include a region 60 having maximum diamond density, all as previously described with reference to FIG. 5. In rotated profile, set 50G is disposed adjacent to set 50F and includes three scribe cutter elements 40*t*, 40*u*, 4O*r*. In the embodiment shown in FIG. 7, elements 40*t–v* include cutting faces 44 having symmetrical cutting profiles of the identical size and shape that are bisected by centerlines 41*t–v*, respectively. As known to those skilled in the art, scribe cutters 40*t*, 40*u*, 40*v* present a relatively sharp point at the cutting tips 45 on bit cutting profile 29. In this embodiment, tips 45 of elements 40*t–v* are aligned in rotated profile; however, elements 40*t–v* are radially spaced apart relative to bit axis 11 such that the cutting profile of each element partially overlaps the cutting profile of each of the other elements 40 in set 50G. As such, the common area of intersection of the cutting profiles of elements 40*t–v* created a region of maximum diamond density as represented by reference numeral 90. Elements 40*t–v* are spaced such that their cutting profile centerlines 41*t–v* pass through region 90. Similarly, adjacent to region 90 in rotated profile are regions 92 that are formed by the intersection of the cutting profiles of two of the elements 40 of set 50G. In this embodiment, regions 92 include a double diamond density. Regions 94 are adjacent to regions 92 and have only a single diamond density.

Cutter sets 50 may be radially positioned from one another so as to form regions of varying diamond density between the areas of maximum diamond density. For example, as shown in FIG. 7, sets 50F and 50G are radially positioned such that, in rotated profile, the cutting profiles of cutter elements 40 of sets 50F, 50G intersect to define three separate border regions of diamond density 73, 74, 75. Region 74 has a double diamond density as defined by the cutting profiles of elements 40*t* and 40*j*. Regions 73 and 75 have a diamond density that is identical to the diamond density of region 60 of cutter set 50F and region 90 of cutter set 50G. Region 73 is defined by the intersection of the cutting profiles of elements 40*i*, 40*j* and 40*t*. Similarly, region 75 is defined by the intersection of the cutting profiles of elements 40*t*, 40*u*, and 40*j*.

Figure 8:
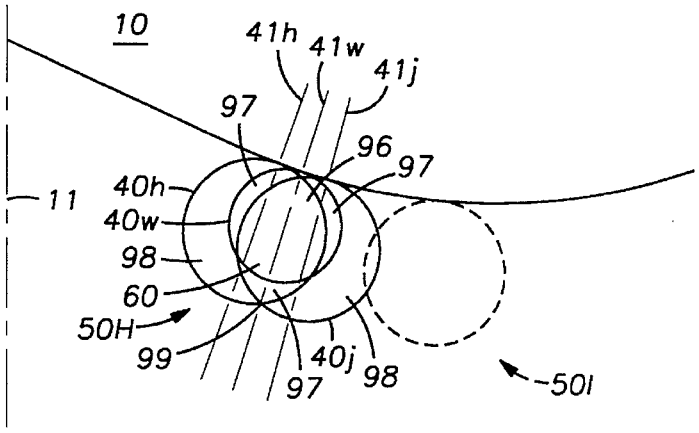

The cutter sets 50 employed in the present invention may also include cutter elements of differing sizes. Shown in FIG. 8 is a cutter element set 50H having cutter elements 40*h* and 40*j* identical to those previously described with reference to FIG. 5. The arrangement of FIG. 8 includes a third cutter element 40*w* having a generally circular cutting face 44 and cutting profile that is smaller in diameter than the cutting faces 44 and cutting profiles of elements 40*h*, 40*j*. Element 40*w* is disposed at a radial position between the radial positions of elements 40*h* and 40*j* such that the cutting profile of elements 40*h*, 40*w*, 40*j* of set 50H define a common region or area of intersection 96 having maximum diamond density which, in this arrangement will have triple diamond density. Elements 40*h*, 40*w*, 40*j* are radially spaced relative to axis 11 such that the cutter profile centerlines 41*h*, 41*w* and 41*j* intersect region 96 of maximum diamond density. As shown, the cutter arrangement shown in FIG. 8 also yields three regions 97 having double diamond density, and two regions 98 of single diamond density. In the embodiment of FIG. 8, cutter element 40*w* is disposed so that it is less exposed to the formation material than elements 40*h* and 40*j*.

The degree of exposure of elements 40*h*, 40*w*, 40*j* may be varied from that shown in FIG. 8. For example, element 40*w* may be set in bit face 20 so as to have an exposure to the formation material that is greater than that shown in FIG. 8. More particularly, cutter element 40*w* may be mounted on bit face 20 such that the cutting profile of dement 40*w* intersects with the cutting profiles of elements of 40*h* and 40*j* at point 99. In that instance, the region 96 of maximum diamond density will be shifted to a position having greater exposure to the formation material compared with the embodiment of FIG. 8, as may be desirable in certain formations or at particular radial locations on the bit face 20.

Figure 9:
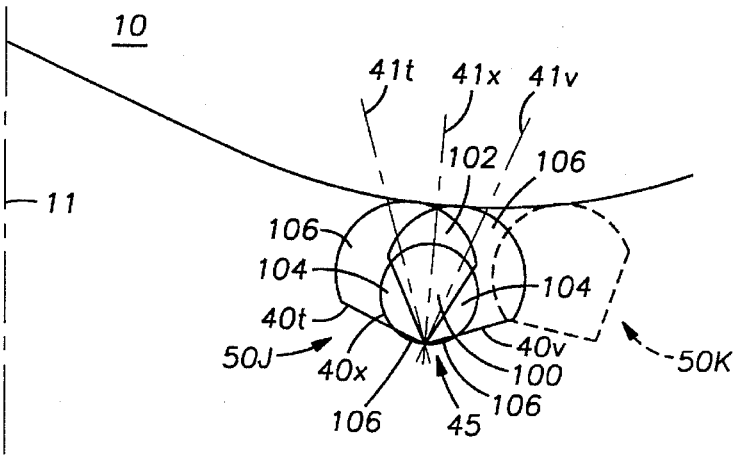

Another embodiment of the invention is shown in FIG. 9. In this embodiment, set 50J includes three elements having differing shaped cutting faces and profiles. More specifically, set 50J includes an element 40*x* having a generally circular cutting face 44 and cutting profile, and scribe elements 40*t*, 40*v* having a shape and structure as described above with reference to FIG. 7. Elements 40*t*, 40*x*, 40*v* include cutting profile centerlines 41*t*, 41*x*, 41*v*, respectively, and are spaced apart radially with respect to bit axis 11. Elements 40*t*, 40*x*, 40*v* are positioned on bit face 20 so that the cutting profile of each element 40 partially overlaps the cutting profile of each of the other elements in the set so as to create a zone or region 100 having maximum diamond density, region 100 being defined by the intersection of the cutting profiles of elements 40*t*, 40*x*, 40*v* when viewed in rotated profile. Similarly, a region 102 of double diamond density is formed by the intersection of the cutting profiles of elements of 40*t* and 40*v*. Regions 104 also have double diamond density and are formed by the intersections of the cutting profile of elements 40*x* with the cutting profiles of either element 40*t* or 40*v*. Areas of single diamond density are represented by reference numeral 106. Profile centerlines 41*t*, 41*x* and 41*v* all intersect the region 100 having maximum diamond density. As is now understood, by varying the radial spacing of cutter elements 40 within the sets 50, the radial spacing between sets 50, the size, shape, cutting profile, and exposure height of the elements 40, any of a variety of diamond densities can be achieved across the bit face as may be desirable for drilling in various types of formations and formation hardnesses.

Figure 10:
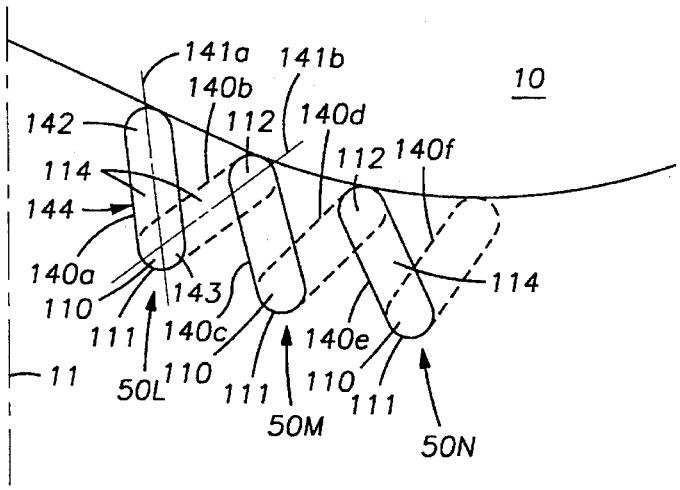
FIG. 10 is a view similar to FIG. 5 showing another alternative embodiment of the present invention which includes cutter elements with elongate cutting faces and cutting profiles.

Another alternative embodiment of the present invention is shown in FIG. 10. In this embodiment, bit 10 includes cutter elements 140*a*–140*f* arranged in cutter element sets 50L, 50M and 50N. Each set 50L, 50M, 50N includes two cutter elements 140 having elongate and symmetrical cutting faces 144 and cutting profiles. The cutting profiles of elements 140*a*–140*f* include a root end 142 and a terminal end 143 opposite root end 142. Cutter elements 140*a*–140*f* having such elongate shaped cutting faces are available from various manufacturers such as Smith Sii Megadiamond, Inc. and General Electric Company. Elements 140*a*, 140*c*, 140*e* are preferably positioned on the same cutter blade, for example blade 31 shown in FIG. 2, while elements 140*b*, 140*d*, and 140*f* are preferably positioned on a second blade, such as blade 32, which follows behind blade 31 as bit 10 is rotated in the borehole. As shown in FIG. 10, each of sets 50L, 50M, 50N include a region of maximum diamond density 110 formed by the overlap or intersection of the cutting profiles of the cutters 140 in the respective sets 50. More specifically, a teardrop shaped region of maximum diamond density 110 is formed adjacent to the terminal ends 143 of elongate elements 140. In this arrangement, regions 110 having the maximum diamond density form that portion of the cutting structure 14 that is most exposed to the formation material. The centerline 141 of the cutting profiles of elements 140 intersect regions 110 in their respective cutter sets 50 as shown.

The cutting profiles of sets 50L, 50M, 50N themselves overlap in rotated profile to the extent represented by border regions 112. As described with reference to the previous embodiments, the diamond density of the border regions 112 formed by the overlap of cutting profiles of adjacent cutter sets 50 is equal to or less than the diamond density of the region 110. In the embodiment of FIG. 10, region 112 has a teardrop shape and a double diamond density, and thus has the same diamond density as region 110. Between regions 110, 112 of double diamond density, central portions 114 of the cutting profiles of cutter elements 140 provide only single diamond density. Although not shown in FIG. 10, additional elongate cutter elements 140 (or other shaped cutter elements) could be employed in sets 50L–50N to have cutting profiles overlapping with region 110 to increase the diamond density in region 110 should it be desirable in a particular design; however, the diamond density of boarder regions 112 will be less than or equal to the diamond density of regions 110.

Figure 11:
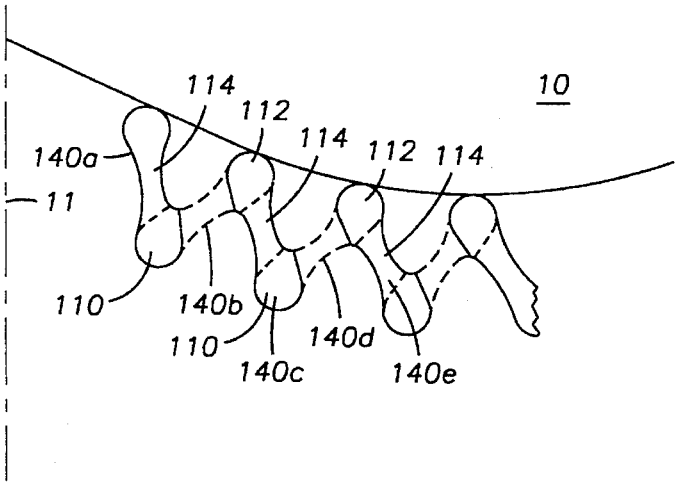
FIG. 11 is a view similar to FIG. 10 showing the cutting profiles of the cutter elements of FIG. 10 after wear has occurred.

The embodiment of FIG. 10 will maintain an aggressive cutting profile useful in relatively hard formation drilling and one in which stability of the bit is maintained as wear occurs. Referring momentarily to FIG. 11, there is shown a representation of the cutting profile of sets 50L, 50M and 50N after substantial wear has occurred to the cutting structure of the bit 10. As shown, because of the overlapping cutter profiles and higher diamond densities in regions 110 and 112, less wear occurs in those regions than in central portions 114, for example, which have only single diamond density.

Although the cutter elements shown in FIG. 10 have a generally uniform width along their length, any of a variety of other shaped elongate cutters may likewise be employed. For example, bit 10 may include sets of cutter elements 500, 50P, 50Q shown in FIG. 12 wherein each of the cutter elements 140*g*–*l* includes a "link" or "dogbone" shaped cutter element and cutting profile. The cutting profile of elements 140*g*–*l* have root ends 142 and terminal ends 143 that are wider than the central portions 111. Referring momentarily again to FIG. 11, it is shown that the cutter elements 140*a*–*f* of FIG. 10 tend to assume the same or similar link or dogbone profile after some wear has occurred. For this reason, and to maintain the stability of the bit, both initially and after wear has occurred, cutter elements 140*g–l* with cutting profiles as shown in FIG. 12 may be particularly desirable.

Figure 12:
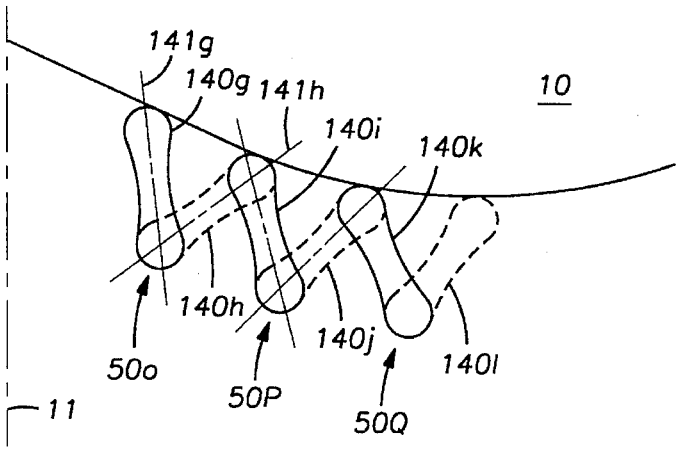
FIGS. 12–16 are views similar to FIG. 10 showing still further alternative embodiments of the present invention.
Figure 13:
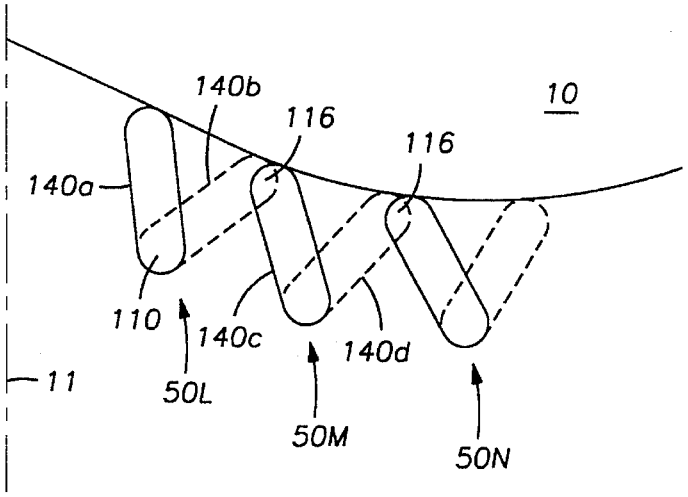
Figure 14:
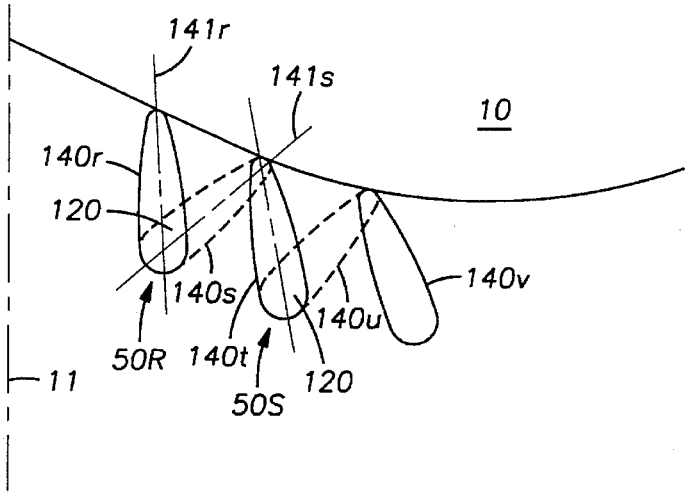
Figure 15:
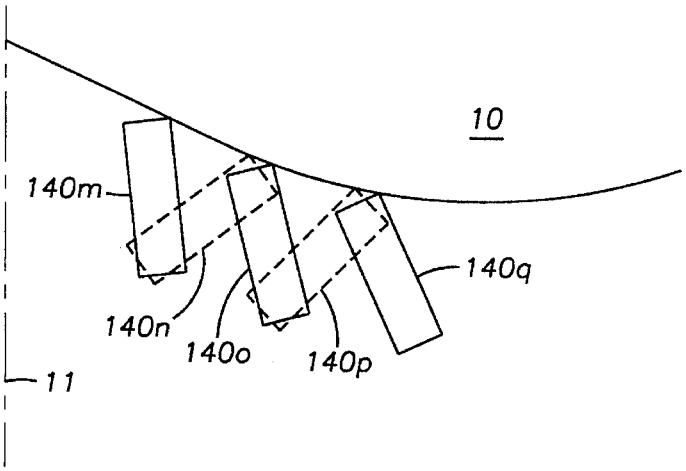

As another alternative to the cutter arrangements shown in FIGS. 10 and 12, cutter elements 140 may have generally rectangular shaped cross sections and cutting profiles as with elongate cutter elements 140*m–q* shown in FIG. 15. A still further alternative is shown in FIG. 14 where elongate cutter elements 140*r–v* include a generally teardrop shape. The width of the cutting profile of each teardrop shaped cutter element 140*r–v* is greater at the terminal end 143, the end most exposed to the formation material, than at the root end of the cutter. Region 120 defines the region of maximum diamond density of each set 50 and is intersected by cutting profile centerlines 141 of each cutter 140 in the set 50. The teardrop shape of elements 140*r–v* and the overlapping of cutting profiles shown will obviously save the material costs associated with making the PDC cutter elements having larger cutting profiles, but will still provide the increased diamond density at regions 120 as desirable for providing an aggressive cutting structure and maintaining stability of the bit as wear occurs. Similarly, as shown in FIG. 13, cutter sets 50L–N having cutter elements 140*a–f* with the cutting profiles previously shown in FIG. 10 may be spaced apart on the bit face such that the extent of overlap between the profiles of cutter element sets 50L, 50M, 50N is minimized, or at least less than the more extensive region of overlap 112 shown in FIG. 10. The partial or less extensive overlap shown in regions 116 of FIG. 13 will nevertheless help protect the bit body from abrasion by providing a region of diamond density higher than would be provided if the sets did not overlap one another. The greater overlap in regions 110 and the resulting longer-wearing areas will again help maintain the stability of the bit.

Figure 16:
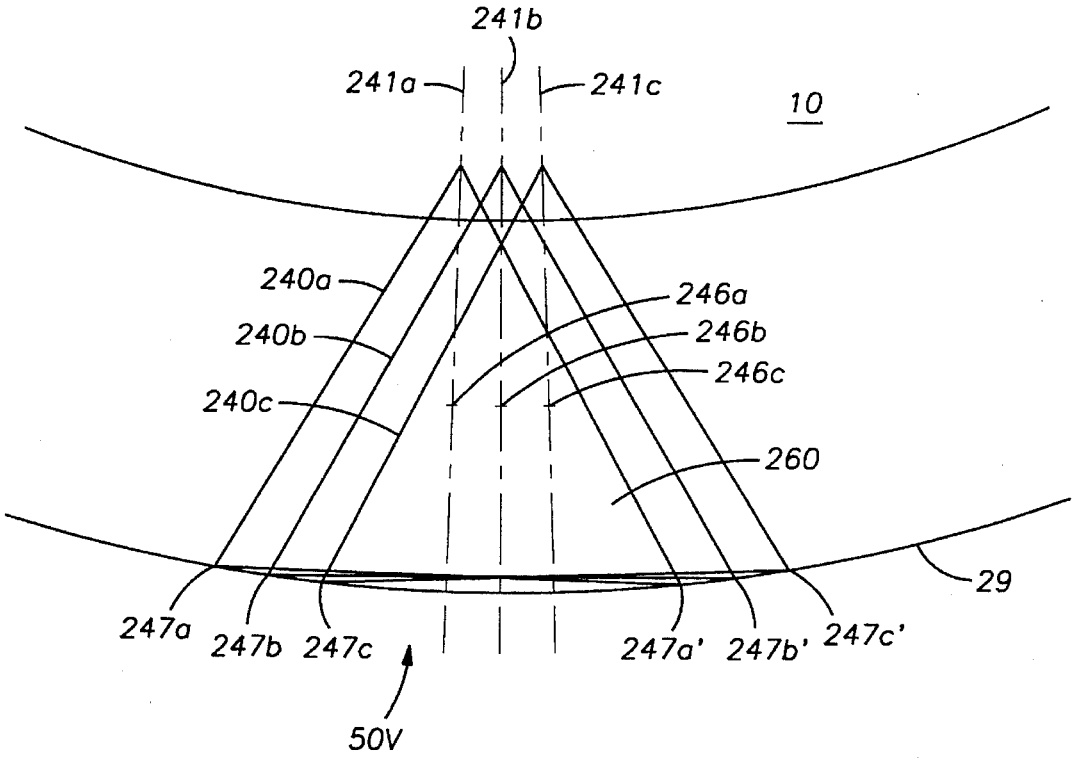

The present invention may be practiced in a bit and cutting structure having cutter elements that, in rotated profile, have more than a single point on the bit cutting profile. For example, FIG. 16 shows bit 10 having a cutter set 50V which includes three cutter elements 240*a–c* spaced apart so as to create a region of maximum diamond density 260 in rotated profile. In this embodiment, each cutter 240*a–c* has a symmetrical cutting profile which includes a pair of points 247 that lie on the bit cutting profile 29. As shown, the centerlines 241*a–c* of cutting profiles of cutters 240*a–c*, respectively, intersect the region of maximum diamond density 260. As used herein, the term centerline, when applied to a cutting profile having more than a single point on the bit cutting profile 29, is a line that passes through the centroid 246 of the cutting profile and that is substantially normal to the bit cutting profile 29. In the embodiment shown, because the cutting profiles of elements 240*a–c* are symmetrical, centerlines 241*a–c* bisect the cutting profiles of their respective cutter elements.

While the preferred embodiments of the invention have been shown and described, modifications thereof can be made by one skilled in the art without departing from the spirit and teachings of the invention. The embodiments described herein are exemplary only, and are not limiting. Many variations and modifications of the invention and the principles disclosed herein are possible and are within the scope of the invention. Accordingly, the scope of protection is not limited by the description set out above, but is only limited by the claims which follow, that scope including all equivalents of the subject matter of the claims.

What is claimed is:

1. A drill bit for drilling through formation material when said bit is rotated about its axis, said bit comprising:

a bit body;

a bit face on said body;

at least one set of cutter elements mounted on said bit face, said cutter element set comprising a plurality of cutter elements mounted at differing radial positions relative to the bit axis and having cutting faces with cutting profiles for engaging and cutting formation material, said cutting profiles of said cutter elements in said set defining a set cutting profile of said set;

at least one adjacent cutter element mounted on said bit face at a radial position that differs from the radial positions of said cutter elements of said set and having a cutting profile that partially overlaps, in rotated profile, with said set cutting profile forming a border region of overlap;

wherein, in rotated profile, each cutter element in said set has a cutting profile that partially overlaps the cutting profile of each of the other cutter elements in said same set so as to form a region of maximum diamond density, said region of maximum diamond density being the common area of intersection of said cutting profiles of said cutter elements of said set; and wherein the centerlines of the cutting profiles of said cutter elements in said set all intersect said region of maximum diamond density; and wherein, in rotated profile, said set cutting profile does not fall entirely within the cutting profile of any other cutter element on said bit and wherein said common area of intersection does not overlap with any border region.

2. The drill bit of claim 1 wherein the cutting profiles of said cutter elements of said set have substantially the same shape and wherein said bit further includes at least one cutter element mounted on said bit face in a redundant position to at least one of said cutter elements of said set.

3. The drill bit of claim 2 wherein the cutting profiles of said cutter elements of said set vary in size.

4. The drill bit of claim 1 wherein the cutting profiles of said cutter elements of said set vary in shape.

5. The drill bit of claim 4 wherein said set includes at least one round cutter element having a generally circular shaped cutting profile and at least one scribe cutter element having a cutting profile that includes a cutting tip, and wherein the terminal edge of said cutting profile of said round cutter is aligned with said cutting tip of said scribe cutter when viewed in rotated profile.

6. The drill bit of claim 1 wherein at least two of said cutter elements of said cutter set are scribe cutters having a cutting profile that includes a cutting tip, and wherein said cutting tips of said scribe cutters, in rotated profile, are aligned.

7. The drill bit of claim 1 wherein at least two of said cutter elements in said set are mounted on said bit face at different exposure heights.

8. The drill bit of claim 1 wherein said set includes at least two cutter elements having elongate cutting profiles with root ends and terminal ends, said terminal ends being more exposed to the formation material than said root ends; and wherein said terminal ends of said elongate cutting profiles overlap in rotated profile to define said region of maximum diamond density.

9. The drill bit of claim 8 wherein said elongate cutting profiles are wider at said terminal ends than at a central location between said root and terminal ends.

10. The drill bit of claim 9 wherein said elongate cutting profiles are link shaped.

11. The drill bit of claim 9 wherein said elongate cutting profiles are teardrop shaped.

12. The drill bit of claim 8 wherein said region of maximum diamond density is teardrop shaped.

13. A drill bit for cutting a borehole in formation material when said bit is rotated about its axis, said bit comprising:

a bit body;

a plurality of cutter element sets disposed on said bit body, each of said cutter element sets including a set cutting profile and a plurality of cutter elements;

wherein each of said cutter elements of said sets includes a cutting face having an element cutting profile for cutting a kerf in the formation material; and wherein said cutter elements of said sets are disposed at spaced-apart positions on said bit body such that, in rotated profile, the element cutting profile of each cutter element in a set partially overlaps the element cutting profile of each of the other cutter elements in the same set and forms a common area of intersection of element cutting profiles, the entirety of said common area of intersection defining a region within said set cutting profile having the maximum diamond density of any region within the set cutting profile;

wherein the centerlines of the cutting profiles of each cutter element in a set pass through said region of maximum diamond density in the set; and wherein, in rotated profile, said set cutting profile of a first cutter element set overlaps with said set cutting profile of at least one other of said cutter element sets and forms at least one border region having a diamond density that is not greater in diamond density than the diamond density of said region of said maximum diamond density of either said first or said second sets; and wherein, in rotated profile, the set cutting profiles of said first and second sets each lies at least partially outside the cutting profile of each cutter element on said bit.

14. The drill bit of claim 13 wherein one of said border regions has a diamond density that is equal to the diamond density of said region of maximum diamond density of said first or second set.

15. The drill bit of claim 13 wherein one of said boarder regions has a diamond density that is less than the diamond density of said region of said maximum diamond density of said first and second sets.

16. The drill bit of claim 13 wherein the number of cutter elements in said first and second sets is different.

17. The drill bit of claim 13 wherein said cutting profiles of said cutter elements in said second set have a different shape than said cutting profiles of said cutter elements of said first set.

18. The drill bit of claim 13 wherein said border region and said regions of maximum diamond density have substantially the same shape, and where the area of said regions of maximum diamond density is larger that the area of said border region.

19. The drill bit of claim 13 wherein said cutter elements of at least one of said sets include cutter elements having cutting profiles of differing shapes.

20. The drill bit of claim 13 wherein said bit includes cutter elements mounted on said bit body in redundant positions to the cutter elements of said first set.

21. The drill bit of claim 13 wherein a given cutter set includes cutter elements disposed at varying exposure heights relative to the formation material.

22. The drill bit of claim 21 wherein said given cutter set includes cutter elements having cutting profiles that are different in shape.

23. A fixed cutter drill bit for drilling through formation material when said bit is rotated about its axis, said bit comprising:

a bit body;

a bit face on said body, said bit face including a plurality of cutter elements mounted thereon and protruding therefrom, said cutter elements having cutting faces and cutting profiles for cutting kerfs through the formation material and being arranged in a plurality of cutter sets, said cutting profiles of said cutter elements in a set defining the cutting profile of the set;

wherein said cutter elements in a given one of said sets are angularly spaced from one another on the bit face; and wherein said cutter elements in said given set are mounted on said bit face such that each cutter element in said given set has a cutting profile that cuts a kerf that at least partially overlaps the kerfs cut by each of the other cutter elements in the same set forming a common area of intersection of the cutting profiles of said cutter elements in said given set when said cutting profiles are viewed in rotated profile, said common area of intersection defining a region within the cutting profile of said given set having a uniform diamond density that is the maximum diamond density of any region within said set cutting profile; and wherein the centerline of the cutting profile of each cutter element in said set passes through said region of maximum diamond density; and wherein the set cutting profile of said given set lies at least partially outside of the cutting profile of every cutter on said bit.

24. The drill bit of claim 23 wherein all the cutter elements in a given set have cutting profiles of substantially the same size, and wherein the width of said region of maximum diamond density is greater than half the width of the cutting profiles of the elements in said given set.

25. The drill bit of claim 23 wherein said sets include set cutting profiles, and wherein the set cutting profile of a first set overlaps with the set cutting profile of a second set when viewed in rotated profile, the area of intersection of the overlapping set cutting profiles forming a border region having a diamond density that is not greater than the diamond density of said region of maximum diamond density of either said first or said second sets.

26. The drill bit of claim 25 wherein said border region comprises a plurality of areas of differing diamond density.

27. The drill bit of claim 26 wherein one of said areas of differing diamond density of said border region has a diamond density equal to the diamond density of said region of maximum diamond density of one of said first or second sets.

28. The drill bit of claim 25 wherein said regions of maximum diamond density of said first and second sets each have widths that are greater than the width of said border region.

29. The drill bit of claim 23 wherein at least one of said sets includes elements having cutting profiles that differ in width, and wherein said region of maximum diamond density of said set has a width not less than the one half the width of the smallest element in said set.

30. The drill bit of claim 23 wherein the number of cutter elements in adjacent sets increases upon moving in a radial direction away from the bit axis.

31. The drill bit of claim 23 wherein said bit face includes a central portion and a shoulder portion and wherein said regions of maximum diamond density are more closely spaced in said shoulder portion of said bit face than in said central portion.

32. A fixed cutter drill bit for drilling through formation material when said bit is rotated about its axis, said drill bit comprising:

a bit body including a bit face having a plurality of radially disposed blades angularly spaced from one another;

cutter elements disposed in rows on said blades, each of said rows including a plurality of cutter elements radially spaced from each other relative to the bit axis, said cutter elements in said rows having cutting faces with cutting profiles for cutting formation material;

wherein said cutter elements are arranged in sets, each of said sets having a set cutting profile defined by said cutting profiles of said cutter elements in said set and comprising a first cutter element on a first blade and a second cutter element on a second blade; and wherein said first and said second cutter elements are mounted at differing radial positions relative to the bit axis and have cutting profiles that, when viewed in rotated profile, fall partially within and partially outside of the cutting profile of each of the other cutter elements in the same set so as to define a region of maximum diamond density for the set; and wherein each of the cutter elements in said same set is positioned such that the centerline of its cutting profile intersects said region of maximum diamond density of the set; and wherein said set cutting profile lies partially outside the cutting profile of every cutter element on said bit.

33. The drill bit of claim 32 wherein a first of said blades includes a row of cutter elements comprising cutters having substantially circular shaped cutting faces.

34. The drill bit of claim 33 wherein a second of said blades includes a row of cutter elements comprising cutters having pointed cutting faces.

35. The drill bit of claim 32 wherein at least one of said rows of cutter elements includes a first plurality of cutter elements having circular cutting faces and a second plurality of cutter elements having pointed cutting faces.

36. The drill bit of claim 32 wherein said first and second cutter elements are scribe cutters having pointed cutting tips, and wherein said pointed cutting tips are aligned with each other when viewed in rotated profile.

37. The drill bit of claim 32 wherein said first and said second cutter elements have elongate cutting profiles having a root end and a terminal end, said terminal end being more exposed to the formation material than said root end, and wherein said cutting profiles of said first and second cutter elements overlap in the region of said terminal ends, and wherein said root ends of said first and second cutter elements do not overlap.

38. The drill bit of claim 37 wherein said region of maximum diamond density is teardrop shaped.

39. The drill bit of claim 32 wherein the set cutting profile of a first set overlaps with the set cutting profile of a second set when viewed in rotated profile, the area of intersection of the overlapping set cutting profiles forming a border region having a diamond density that is not greater than the diamond density of said region of maximum diamond density of either said first or said second sets.

40. The drill bit of claim 39 wherein said first and said second cutter elements in a set have elongate cutting profiles having a root end and a terminal end, said terminal end being more exposed to the formation material than said root end, and wherein said cutting profiles of said first and second cutter elements overlap in the region of said terminal ends to define said region of said maximum diamond density, and wherein said root ends of said first and second cutter elements do not overlap; and wherein said border region is defined by the overlap in cutting profiles of the root ends of cutter elements in adjacent of said sets.

41. The drill bit of claim 40 wherein the cutting profile of at least one of the elongate cutting profiles is wider at the terminal end than at the root end.

42. The drill bit of claim 40 wherein at least one of said cutter elements has an elongate cutting profile that includes a central region disposed between said root end and said terminal end, and wherein said central region is narrower than said root end and said terminal end.

43. The drill bit of claim 40 wherein said cutter elements having elongate cutting profiles have rectangular shaped cutting faces.

44. The drill bit of claim 40 wherein said region of maximum diamond density and said border region have substantially equal areas.

45. The drill bit of claim 40 wherein said region of maximum diamond density has an area that is greater than the area of said border region.

46. The drill bit of claim 32 further comprising a first given set of cutter elements; and additional cutter elements mounted in redundant positions to at least some of the cutter elements of said first given set.

47. A drill bit cutting structure for drilling a borehole in formation material when the bit is rotated about its axis, said cutting structure comprising:

a plurality of spaced sets of cutter elements mounted on a bit face, each of said sets including at least two cutter elements having element cutting profiles radially spaced from one another relative to the bit axis and having a set cutting profile defined by the cutting profiles of said cutter elements in the set;

wherein said cutter elements in said sets are positioned such that, when viewed in rotated profile, a portion of the element cutting profile of each cutter element in the set is hidden from the formation material by a portion of each of the element cutting profiles of the other cutter elements in the same set and such that said cutting profiles of said cutter elements in the set form a common area of intersection, the entirely of said common area of intersection defining a region of maximum diamond density having the greatest diamond density of any region within the set cutting profile; and wherein the cutting profile of each of the cutter elements includes a centerline and wherein said centerlines of the cutting profiles of each of the cutter elements of a set intersect said region of maximum diamond density of that set; and wherein the set cutting profile of each set lies at least partially outside the cutting profile of each cutter element on said cutting structure; and wherein said cutting profiles of at least a first and a second of said cutter sets overlap to a partial extent when viewed in rotated profile forming at least one border region having a diamond density that is not greater than the diamond density of said region of maximum diamond density of either said first or said second sets.

48. A cutting structure for a bit face of a fixed cutter drill bit, said cutting structure comprising:

sets of cutter elements mounted in spaced relationship on the bit face, each of said cutter sets having a set cutting profile and comprising a plurality of spaced cutter elements having element cutting profiles, wherein each set cutting profile is defined by the rotated cutting profiles of the cutter elements in the set and includes a plurality of regions of differing diamond density disposed along the segment of the bit face that is spanned by the set cutting profile; and wherein said set cutting profiles include a region of uniform diamond density that has the maximum diamond density of any region within the set cutting profile of said set, and wherein the centerline of the cutting profile of each of the cutter elements in a set intersects said region of maximum diamond density of the set; and wherein the cutting profile of each cutter element in a set partially but not totally overlaps with the cutting profile of each of the other cutter elements in the same set; and wherein the set cutting profile of each set lies at least partially outside the cutting profile of each cutter element on said cutting structure.

* * * * *